US005998920A

United States Patent [19]

Kim

[11] Patent Number: 5,998,920

[45] Date of Patent: Dec. 7, 1999

[54] CONDUCTIVE COATING FOR THE INTERIOR OF A CATHODE RAY TUBE

[75] Inventor: Sang-Mun Kim, Seoul, Rep. of Korea

[73] Assignee: LG Electronics Inc., Seoul, Rep. of Korea

[21] Appl. No.: 08/977,888

[22] Filed: Nov. 25, 1997

[30] Foreign Application Priority Data

Nov. 26, 1996 [KR] Rep. of Korea ..... 1996-57314

[51] Int. Cl.[6] ..... H01J 31/00

[52] U.S. Cl. ..... 313/479

[58] Field of Search ..... 313/479, 477 R

[56] References Cited

U.S. PATENT DOCUMENTS

| | | | |
|---|---|---|---|
| 3,791,546 | 2/1974 | Maley et al. | 220/2.1 A |
| 3,979,632 | 9/1976 | Gunning et al. | 313/479 |
| 4,041,347 | 8/1977 | Deal et al. | 313/450 |
| 4,092,444 | 5/1978 | Kilichowski | 427/64 |
| 4,124,540 | 11/1978 | Foreman et al. | 252/518 |
| 4,210,844 | 7/1980 | Buescher et al. | 313/479 |
| 4,251,749 | 2/1981 | Compen et al. | 313/479 |

OTHER PUBLICATIONS

"An Improved Shadow–Mask System for Large Size CRTs" by Richard C. Bauder and F.R. Ragland, SID Int'l Technical Papers (1990) pp. 426–429, Jan. 1, 1990.

*Primary Examiner*—Vip Patel
*Assistant Examiner*—Matthew Gerike
*Attorney, Agent, or Firm*—Finnegan, Henderson, Farabow, Garrett & Dunner, L.L.P.

[57] ABSTRACT

A coating for an interior of a color cathode ray tube. The coating includes a graphite, two ferric oxides, a disperser for forming a uniform mixture of the graphite and the two oxides, and an adhesive for adhering the coating on the interior of the color cathode ray tube. The first ferric oxide has no $Fe^{2+}$ ions. The other ferric oxide has $Fe^{2+}$ ions and has a grain diameter less than that of the first ferric oxide. The coating eliminates internal discharging of the CRT when the power is switched on or off.

33 Claims, 3 Drawing Sheets

CONDUCTIVE COATING FOR THE INTERIOR OF A CATHODE RAY TUBE

BACKGROUND OF THE INVENTION

A. Field of the Invention

The present invention relates to an interior coating for a color CRT (cathode ray tube).

B. Description of the Prior Art

A typical color CRT is illustrated in FIG. 1. A panel 1, the inside of which is covered with a fluorescent layer 10, is sealed to a funnel 2, the inside of which is covered with an electroconductive graphite coating, through the melting of frit glass in a furnace at about 450° C. to create a sealed unit. The neck 7 of the funnel 2 contains three electron guns 3 that generate and direct streams of free electrons in three separate electron beams. A frame 5 is attached to the inside of the panel 1 so as to support a shadow mask 4, which serves as electrodes filtering electron beams by three colors. A deflection yoke 8 surrounds the neck of the CRT at the junction of the neck 7 with the funnel 2. Reference numeral 5' represents a contact spring.

With the color CRT as constructed above, when an image signal is transmitted to the electron guns 3, the cathodes of the guns 3 generate electrons that accelerate towards and are focused on the back surface of the panel 1.

The electron beams 9 are deflected by the magnetic field of the deflection yoke 8, which is installed around the neck 7, and pass through the slots of the shadow mask 4 which is suspended by the frame 5. Passing through the slots, each of the beams 9 is filtered to strike only its intended color dot. Thus the filtered electron beams 9 strike the three sets of colored phosphor dots in the fluorescent layer on the inside surface of the panel so as to produce the desired pixel colors.

An inner shield 6 is installed behind frame 5 so that the electron beams are not deflected under the influence of the terrestrial magnetic field when they pass through the slots of the shadow mask and arrive at the fluorescent layer.

Referring to a CRT 20 in FIG. 2, a panel 1 is sealed to a funnel 2 at a fusion junction. Internal and external conductive coatings, 21 and 22, are applied to the inner and outer surfaces of the funnel 2, and serve as a condenser. When high voltages are applied to a cavity 23 of the CRT 20, an image is produced on the face of the tube.

In the manufacture of the tube, the conductive coating is made from a mixture of graphite, an adhesive (water glass), and a disperser. Modern conductive coatings are treated with metal oxides to produce a surface with increased electric resistance.

A conventional conductive coating has been applied with a brush or a sponge, or may be sprayed, or applied with a deposition or flow coating method. The flow coating method in which deposit of the conductive coating is easily achieved at a time is the most widely used of the methods to coat the inside of the tunnel. When depositing the conductive coating on the outside of the funnel, a brush or a sponge is used.

Of the constituents cf the conductive coating, graphite is a conductive material that permits the current applied through the cavity to flow across the conductive coating towards the electron guns.

An adhesive consisting of potassium silicate and sodium silicate makes it easy to bond graphite and metal oxides to the glass surface of the funnel.

A disperser is added to the conductive coating to disperse the graphite and metal oxides in the glass water mixture containing distilled water.

The metal oxides added to the conductive coating with graphite, are nonconducting substances to increase the electric resistance. Usually ferric oxide ($Fe_2O_3$) or titanium dioxide ($TiO_2$) are used.

When using a conductive coating which contains no metal oxides, contaminants in the electron guns can cause electric sparks. Thus generated high current between 600 and 1000 Å can damage the conductive coating which is in contact with the electron guns and the components of the electric circuit of the CRT.

To solve the above mentioned problem, existing conductive coatings made from the mixture of graphite, an adhesive, and a disperser are treated with nonconductive material such as metal oxides, ferric oxide or titanium dioxide.

The specific gravities of ferric oxide and titanium dioxide added to reduce overcurrent are higher than that of graphite so that layer separation occurs in a conductive coating solution left as it is or deposited on the funnel: heavier ferric oxide and titanium dioxide settle first and the lighter graphite is concentrated on the top.

When the conductive coating with the graphite layer is concentrated on the top after being deposited and dried, the resistance decreases with the increase of the conductivity, thereby providing the same problem as the conductive coating with no metal oxide. In addition, excessive time is required to disperse the settled metal oxides and the conductive coating is not uniformly deposited.

When the conductive coating is deposited by means of a brush or a sponge, the depositing process is complex and the conductive coating is not uniform. The spray painting has the limitation that the coating may be stained in the dispersed condition of the graphite slurry.

Using the deposition or the flow coating method the coating tends to be applied to undesired areas, which requires additional process to remove the undesired coating and also wastes conductive materials. The inside surface of the funnel may also have the electric resistance properties that arc not uniform because the coating streams down the inside surface of the funnel and thus the coating's thickness varies from the upper part of the funnel to the yoke section.

The difference in potential between the spring and the conductive coating can cause internal discharging when the CRT is turned on or off, especially when the electric resistance is as high as above 5 KΩ at the contact area between the contact spring and the conductive coating. Thus the difference in potential destroys the conductive coating in contact with the spring. Due to the damaged coating, high voltage applied to the cavity of the CRT cannot flow uniformly across on the inside surface of the funnel, and the panel cannot display any images.

SUMMARY OF THE INVENTION

Accordingly, the present invention is directed to an interior coating for a color CRT that substantially obviates one or more of the problems due to limitations and disadvantages of the related art.

An object of the present invention is to provide an interior coating for a color CRT, coated over the inside surface of the CRT, that prevents internal discharging of the CRT.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention as embodied and broadly described herein, the invention comprises a coating for the interior of a cathode ray tube, including a first metal oxide having substantially no ions and a second metal oxide having ions.

In another aspect, the invention comprises a cathode ray tube having an exterior surface, an interior surface, and a coating over the interior surface, wherein the coating includes a first metal oxide having substantially no ions and a second metal oxide having ions.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE PREFERRED EMBODIMENTS

Figure 1:
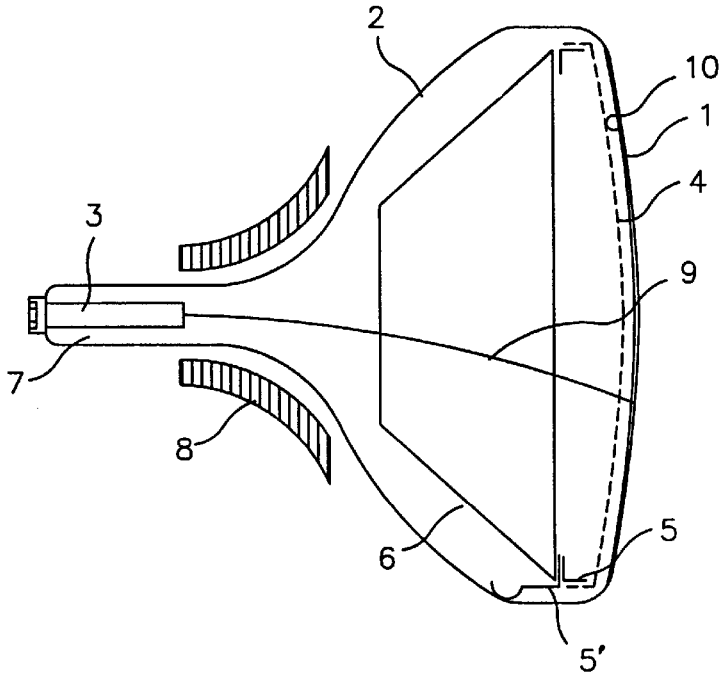
FIG. 1 is a schematic diagram of a color CRT.
Figure 2:
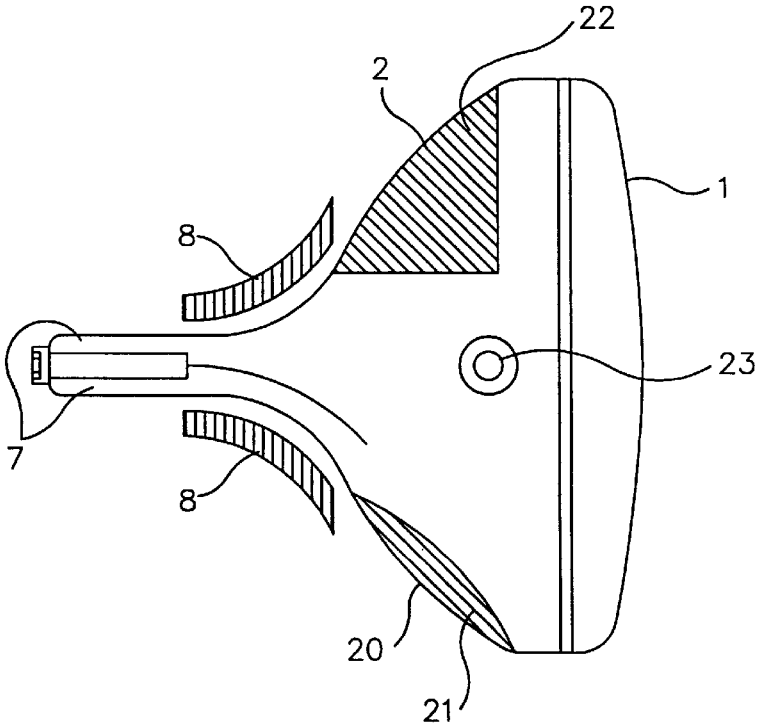
FIG. 2 shows where internal and external conductive coating are applied in the color CRT.

Reference will now be made in detail to the preferred embodiments of the present invention, examples of which are illustrated in the accompanying drawings.

A conductive coating of the present invention has the following coating compositions.

(1) Conductive material:

Graphite powder: 1–30 wt %, with a 0.1–20 $\mu$m grain diameter.

Ferric oxide 1: 5–30 wt %, with a 0.1–20 $\mu$m grain diameter, and free of $Fe^{2+}$ ions.

Ferric oxide 2: 0.5–30 wt %, containing at least 5 wt % $Fe^{2+}$ ions, and less than 1000 Å grain diameter.

(2) Adhesive: 5–30 wt %, containing potassium silicate or sodium silicate.

(3) Disperser 1: 0.5–3 wt %, containing polymethylene bisnaphthalene sodium sulfonate.

(4) Disperser 2: 0.5–3 wt %, containing sodium salt of condensed naphthalene sulfonic acid.

(5) Distilled water: 60–80 wt %.

The constituents of the coating solution of the present invention are described as follows.

Graphite, which acts as a conductive material, permits current to flow from electron guns towards a fluorescent body in a CRT. When used in the present invention, it is mixed with ferric oxide because the electric resistance varies according to the ratio of the graphite to the ferric oxide. The mixture for a CRT preferably contains 1–30 wt % graphite.

When the graphite added is less than 1 wt %, the conductive coating exhibits a relatively low conductivity compared with strong electric resistance. When the graphite exceeds 30 wt %, overcurrent generated cause, electric sparks on the electron guns that are stained with alien substances. Thus-generated high current between 600 and 1000 Å damages the conductive coating in contact with the electron guns and the components of the electric circuit of the CRT.

The present invention employs ferric oxides, generally in the form of red or yellowish brown ferric oxide ($Fe_2O_3$) that is nearly free of $Fe^{2+}$. Ferric oxides increases the resistance of the coating to decrease the overcurrent flowing across the inside surface of the CRT to protect the CRT and its electric circuits. These oxides are added to the conductive coating, usually 5–30 wt %, and preferably 10–20 wt %. When less than 5 wt % is added, ferric oxide has no effect on the electric resistance of the conductive coating. Addition of ferric oxide, in excess of 30 wt %, increases the electric resistance too much, and makes it difficult to create a desired conductive coating, resulting in a nonuniform mixture of graphite and ferric oxide that is separated into two distinct layers according to their respective densities.

When the ferric oxide particle size exceeds 20 $\mu$m in grain diameter, coarse surface of the conductive coating is produced. Ferric oxide in the present invention has good disperse qualities and is less than 20 $\mu$m in grain diameter.

Furthermore, the present invention solves the problem of sparks caused by the decrease of the electric resistance of the contact area with the contact spring by using ferric oxide which has less than 1000 Å grain diameter and contains more than 5 wt % $Fe^{2+}$ serving as ferric oxide and a conductive material.

According to the present invention, the conductive coating is prepared from a black mixture of graphite and ferric oxide in the desired ratio, so that ferric oxide has a $Fe^{2+}$ content of more than 5 wt %. Thus the ferric oxide is used in the form of $(FeO)\times(Fe_2O_3)_{1-x}(X\geqq 0.1)$.

A desired property of the present invention cannot be attained if the coating has an $Fe^{2+}$ content of less than 5 wt % in ferric oxide, because the coating does not exhibit a sufficient conductivity.

The $Fe^{2+}$ content in ferric oxide is readily detected by means of a chemical analysis.

In general, a $Fe^{2+}$ content in excess of 5 wt % makes ferric oxide magnetic material and increases a coercive force of the ferric oxide, which deteriorates the function of an inner shield installed in order to prevent a deflection of the electron beams by the terrestrial magnetic field. The electron beams are readily deflected towards the ferric oxide due to its coercive force, resulting in inferior images.

However, when the granule diameter is less than 1000 Å, even if the $Fe^{2+}$ content is more than 5 wt %, the coercive force of a magnetic body is less than 1 Oe which is lower than that of the inner shield. Thus, the ferric oxide employed in the present invention does not generate the coercive force that inhibits the performance of the inner shield and provides a conductive property without deteriorating image quality, making it possible to regulate the electric resistance of a conductive coating. In addition, the present invention produces a conductive coating that can be uniformly deposited without layer separation from graphite because that the ferric oxide is readily dispersed in the conductive coating due to the small density of the magnetic substance.

Silicates having constituents similar to glass are used as the bonding agent which firmly adhere the mixture of graphite and ferric oxide to the glass surface of the funnel. The silicates include potassium silicate and sodium silicate.

The coating containing less than 5 wt % silicates is subject to exfoliation due to weak adhesive strength, which causes electric sparks and makes the shadow mask choked up. Silicate contents exceeding 30 wt % may increase the adhesive strength, but too much silicates generate excessive $CO_2$ gas, and makes the funnel hard to clean with fluoric acid solutions.

The disperser is selected from polymethylene bisnaphthalene sodium sulfonate or sodium salt of condensed naphthalene sulfonic acid. It disperses the particles of graphite and ferric oxide uniformly so as to produce a uniform coating with sufficient conductivity and to prevent the particles from settling on the coating.

PREFERRED EMBODIMENT

Graphite powder with 5–10 μm grain diameter was added to constitute 10 wt %, in order to regulate the coating's conductivity. Granular ferric oxide with 10 μm average grain diameter and containing no $Fe^{2+}$ ion was added to constitute 8 wt %. Ferric oxide with 500 Å average grain diameter with $Fe^{2+}$ ions constituting 25 wt %, was added to constitute 15 wt % of the coating composition. An adhesive consisting of potassium silicate and sodium silicate was added to constitute 12 wt %. The conductive coating employed a disperser consisting of polymethylene bisnaphthalene sodium sulfonate to constitute 2 wt % and sodium salt of condensed naphthalene sulfonic acid to constitute 1 wt %. Distilled water was added to constitute 60 wt % of the coating composition. The finished coating composition was then deposited on a funnel by means of a flow coating method.

COMPARATIVE EXAMPLE

Graphite powder with 10 μm grain diameter was added to a conductive coating to constitute 15 wt %, in order to regulate the coating's conductivity. Granular ferric oxide with 10 μm average grain diameter and containing no $Fe^{2+}$ ion was added to constitute 15 wt % of the coating composition. An adhesive consisting of potassium silicate and sodium silicate was added constituting 12 wt %. The conductive coating was applied with a disperser consisting of polymethylene, bisnaphthalene and sodium sulfonate to constitute 2 wt %, and sodium salt of condensed naphthalene sulfonic acid to constitute 1 wt %. Distilled water was added constituting 60 wt % of the coating composition. The finished coating composition was then deposited on a funnel by means of a flow coating method.

Figure 3:
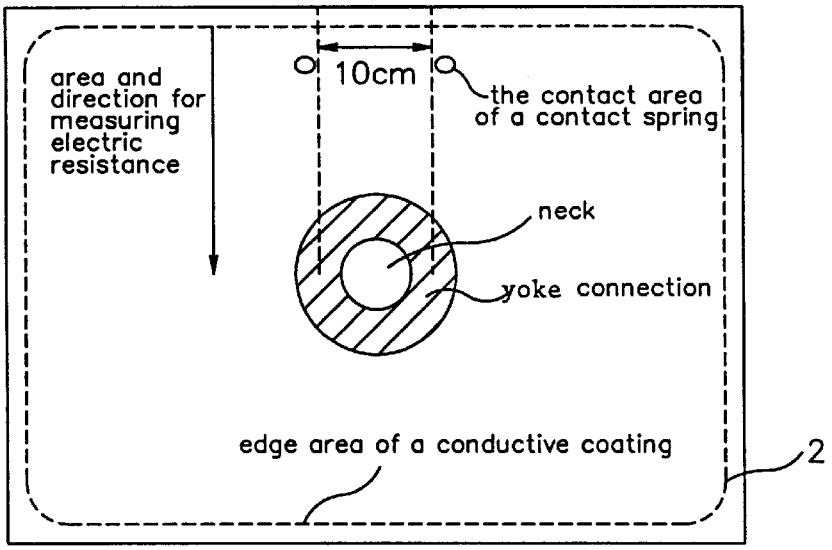
FIG. 3 is a diagram illustrating a direction for measuring the electric resistance taken from a view of a funnel.

An assay was tried on the electric resistance of the funnels which is coated with the coating compositions of the above embodiment and comparative example. The resistances at the areas of the funnels were analyzed in the measurement direction as shown in FIG. 3. In addition, an assay was carried out as to the presence of an exfoliation of the conductive coating at the contact area of a contact spring when the CRT was turned on and off in succession for 10,000 times.

The results of the analyses are described with reference to Table 1 and Table 2 as follows.

Figure 4:
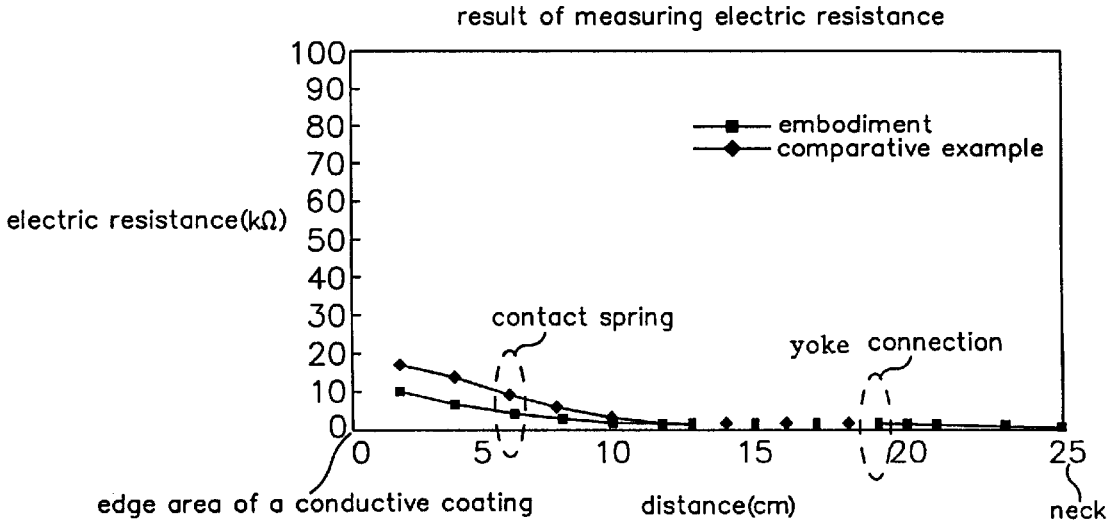
FIG. 4 shows the electric resistance from the inside edge of the funnel to a neck.
Figure 5:
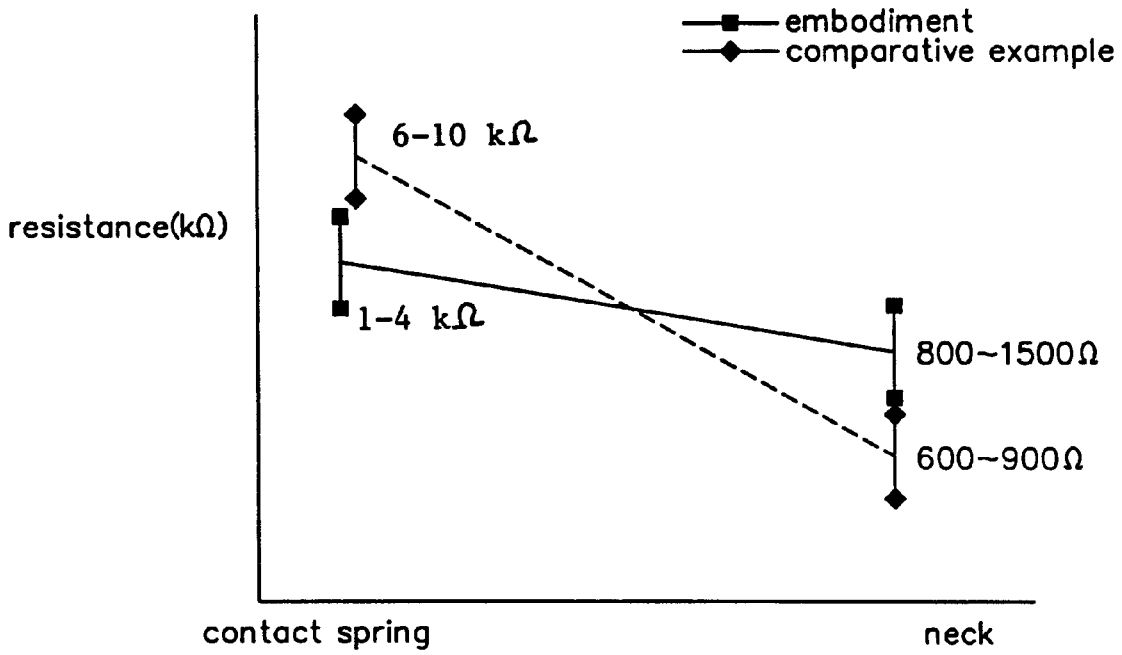
FIG. 5 is a diagram comparing the electric resistance at the contact area in contact with a contact spring to the neck.

Table 1 reveals that the present invention produced no discharges at the contact area of the contact spring because the coating exhibits the conductivity less than 5 kΩ irrespective of the coating's thickness. The coating is not readily exfoliated because of low electric resistance, as shown in Table 2, FIG. 4 and FIG. 5.

TABLE 1

The Comparison of The Electric Resistances

| THICKNESS OF COATING (μm) | EMBODIMENT (kΩ) | COMPARATIVE EXAMPLE (PRIOR ART) (kΩ) |
|---|---|---|
| 25 | 3.75 | 24.73 |
| 50 | 1.75 | 18.83 |
| 75 | 1.54 | 13.67 |
| 100 | 0.83 | 9.84 |
| 125 | 0.45 | 5.53 |
| RESULT | NO SPARK | COATING DESTROYED AFTER SPARK DISCHARGE |

TABLE 2

The Comparison of The Discharge Properties

| THICKNESS OF COATING (μm) | DISCHARGING EFFECT WHEN CRT IS TURNED ON OR OFF IN SUCCESSION FOR 10,000 TIMES |
|---|---|
| EMBODIMENT | NO SPARK |
| COMPARATIVE EXAMPLE (PRIOR ART) | COATING DESTROYED AFTER SPARK DISCHARGE |

As a result, the conductive coating solution of the present invention is fabricated form ferric oxide which has less than 1000 Å grain diameter and contains 5 wt % $Fe^{2+}$ ions, granular ferric oxide which has less than 20 μm grain diameter and has no $Fe^{2+}$, and graphite. The coating solution is applied on the inside surface of the funnel of a CRT. Thus the electric resistance is reduced at the contact area of a contact spring without large decrease of the resistance at the neck of the funnel, thereby preventing internal discharging of the CRT when it is turned on or off.

It will be apparent to those skilled in the art that various modifications and variations can be made in the interior coating for a color CRT of the present invention without departing from the spirit or scope of the invention. Thus, other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A coating for an interior of a color cathode ray tube, comprising:

graphite;

a first metal oxide having substantially no ions; and a second metal oxide having ions.

2. The coating for an interior of a color cathode ray tube according to claim 1, wherein said first metal oxide has a first grain diameter and said second metal oxide has a second grain diameter less than said first grain diameter.

3. The coating for an interior of a color cathode ray tube according to claim 1 wherein said first metal oxide includes a ferric oxide having substantially no $Fe^{2+}$ ions.

4. The coating for an interior of a color cathode ray tube according to claim 1, wherein said second metal oxide includes a ferric oxide having $Fe^{2+}$ ions.

5. The coating for an interior of a color cathode ray tube according to claim 1, further comprising a disperser for forming a uniform coating.

6. The coating for an interior of a color cathode ray tube according to claim 5, wherein said disperser includes polymethylene bisnaphthalene sodium sulfonate.

7. The coating for an interior of a color cathode ray tube according to claim 5, wherein said disperser includes a sodium salt of condensed naphthalene sulfonic acid.

8. The coating for an interior of a color cathode ray tube according to claim 5, wherein said disperser constitutes 0.5–6 wt % of said coating.

9. The coating for an interior of a color cathode ray tube according to claim 1, further comprising an adhesive for adhering said coating over the interior of the color cathode ray tube.

10. The coating for an interior of a color cathode ray tube according to claim 9, wherein said adhesive constitutes 5–30 wt % of said coating.

11. The coating for an interior of a color cathode ray tube according to claim 9, wherein said adhesive includes potassium silicate or sodium silicate.

12. The coating for an interior of a color cathode ray tube according to claim 1, wherein:

said first metal oxide includes a first ferric oxide having substantially no $Fe^{2+}$ ions and said second metal oxide includes a second ferric oxide having $Fe^{2+}$ ions.

13. The coating for an interior of a color cathode ray tube according to claim 12, wherein said second ferric oxide having $Fe^{2+}$ ions constitutes 0.5–30 wt % of said coating.

14. The coating for an interior of a color cathode ray tube according to claim 12, wherein said first ferric oxide has a grain diameter of 0.1–20 $\mu$m.

15. The coating for an interior of a color cathode ray tube according to claim 12, wherein said second ferric oxide has a grain diameter of less than 1000 Å.

16. The coating for an interior of a color cathode ray tube according to claim 12, wherein said first ferric oxide has a grain diameter of 0.1–20 $\mu$m and wherein said second ferric oxide has a grain diameter of less than 1000 Å.

17. The coating, for an interior of a color cathode ray tube according to claim 12, wherein said second ferric oxide contains in excess of 5 wt % $Fe^{2+}$.

18. The coating for an interior of a color cathode ray tube according to claim 12, wherein said second ferric oxide constitutes 0.5–30 wt % of said coating and said second ferric oxide contains in excess of 5 wt % $Fe^{2+}$.

19. The coating for an interior of a color cathode ray tube according to claim 12, wherein said second ferric oxide has a grain diameter of less than 1000 Å and wherein said second ferric oxide contains in excess of 5 wt % $Fe^{2+}$.

20. A cathode ray tube comprising:

an exterior surface facing outside of said cathode ray tube;

an interior surface opposite said exterior surface; and a coating over said interior surface, said coating including a first metal oxide having substantially no ions and a second metal oxide having ions.

21. The cathode ray tube according to claim 20, wherein said first metal oxide has a first grain diameter and said second metal oxide has a second grain diameter less than said first grain diameter.

22. The cathode ray tube according to claim 20, wherein said first metal oxide includes a ferric oxide having substantially no $Fe^{2+}$ ions.

23. The cathode ray tube according to claim 20, wherein said second metal oxide includes a ferric oxide having $Fe^{2+}$ ions.

24. The cathode ray tube according to claim 20, wherein said coating includes a graphite.

25. The cathode ray tube according to claim 20, wherein said coating includes a disperser for forming a uniform coating.

26. The cathode ray tube according to claim 20, wherein said coating includes an adhesive for adhering said coating over the interior of the color cathode ray tube.

27. The cathode ray tube according to claim 20, wherein:

said first metal oxide includes a first ferric oxide having substantially no $Fe^{2+}$ ions and said second metal oxide includes a second ferric oxide having $Fe^{2+}$ ions.

28. The cathode ray tube according to claim 27, wherein said second ferric oxide having $Fe^{2+}$ ions constitutes 0.5–30 wt % of said coating.

29. The cathode ray tube according to claim 27, wherein said first ferric oxide has a grain diameter of 0.1–20 $\mu$m.

30. The cathode ray tube according to claim 27, wherein said second ferric oxide has a grain diameter of less than 1000 Å.

31. The cathode ray tube according to claim 27, wherein said first ferric oxide has a grain diameter of 0.1–20 $\mu$m and wherein said second ferric oxide has a grain diameter of less than 1000 Å.

32. The cathode ray tube according to claim 27, wherein said second ferric oxide contains in excess of 5 wt % $Fe^{2+}$.

33. The cathode ray tube according to claim 27, wherein said second ferric oxide constitutes 0.5–30 wt % of said coating and said second ferric oxide contains in excess of 5 wt % $Fe^{2+}$.

* * * * *